United States Patent [19]

Schlagenhaufer

[11] Patent Number: 4,674,763

[45] Date of Patent: Jun. 23, 1987

[54] SKI DAMPING DEVICE

[76] Inventor: Albert Schlagenhaufer, 5055 SE. Lafayette St., Portland, Oreg. 97206

[21] Appl. No.: 851,093

[22] Filed: Apr. 14, 1986

[51] Int. Cl.[4] ..... A63C 5/07

[52] U.S. Cl. ..... 280/602; 220/324

[58] Field of Search ..... 280/601, 602, 809; 188/378; 220/324

[56] References Cited

U.S. PATENT DOCUMENTS

| | | | |
|---|---|---|---|
| 2,455,920 | 2/1948 | Ebbley, Jr. . | |
| 2,715,951 | 8/1955 | Lieber | 188/378 |
| 3,096,530 | 7/1963 | Almgren . | |
| 3,747,947 | 7/1973 | Gunzel | 280/602 |
| 3,761,106 | 9/1973 | Schwarz . | |
| 3,863,944 | 2/1975 | Waddel . | |
| 4,520,423 | 5/1985 | Sutherland | 220/324 X |
| 4,563,020 | 1/1986 | Arieh et al. | 188/378 X |

FOREIGN PATENT DOCUMENTS

| | | | |
|---|---|---|---|
| 2350656 | 4/1975 | Fed. Rep. of Germany | 280/602 |

*Primary Examiner*—John J. Love
*Assistant Examiner*—Michael Mar
*Attorney, Agent, or Firm*—Eugene D. Farley

[57] ABSTRACT

A damping device for controlling the vibration of skis. The device comprises a damper, preferably a pellet packed damper, and a fastener for fastening the same to a selected area of the ski, preferably to the upper surface of the ski tip.

2 Claims, 4 Drawing Figures

SKI DAMPING DEVICE

BACKGROUND AND GENERAL STATEMENT OF THE INVENTION

This invention relates to skis damped to control vibration during use.

As is well known to all skiers, skiing down slopes made rough by the presence of ice, snow lumps, slush, etc. sets up a vibration in the skis. The magnitude of the vibration is determined by such factors as the weight and stiffness of the skis, the material of which they are made, the speed at which the slope is traversed, the nature of the surface, etc.

A certain amount of such vibration is desirable since it breaks at frequent intervals the surface tension bonding which otherwise would bond the ski to the snowy surface. Breaking the bonding results in a lively ski which breaks loose from the underlying surface at frequent intervals, increasing the speed of the traverse and the enjoyment attending the sport. If the bonding were not broken at frequent intervals, the contrary result would obtain: that of skiing on "dead" skis.

However, the frequency and magnitude of vibration must be controlled. If it is excessive, the skier has poor edge control with the result that the skis will slip sideways and track poorly.

It accordingly is the general object of the present invention to provide a ski damping device which may be built integrally into the ski, or applied as an attachment thereto, and which when present will control ski vibration within the desired limits.

It is a further object of the present invention to provide a ski damping device which is simple in construction and installation, which is effective in operation, and which has a service life commensurate with the life of the ski to which it is applied.

Broadly stated, the ski damping device which achieves the foregoing and other objects comprises a pellet-packed damper and fastening means for fastening the same to a selected area of the ski.

In a more specific form, the device comprises a base, and attaching means for attaching the base to a selected area of the ski. A container is fastened to the base by suitable fastening means. Vibration damping means is housed in the container.

The vibration damper preferably comprises a number of inertia pellets, such as lead or steel buckshot, contained in an outer shell. The pellets are arranged in layers. They thus act as energy diffusers or dissipators. When subjected to space displacement, the top pellets push those underneath sideways, thus changing vertical energy into horizontal energy, which is dispersed in all directions, nautralizing itself.

THE DRAWINGS

DESCRIPTION OF A PREFERRED EMBODIMENT OF THE INVENTION

Figure 3:
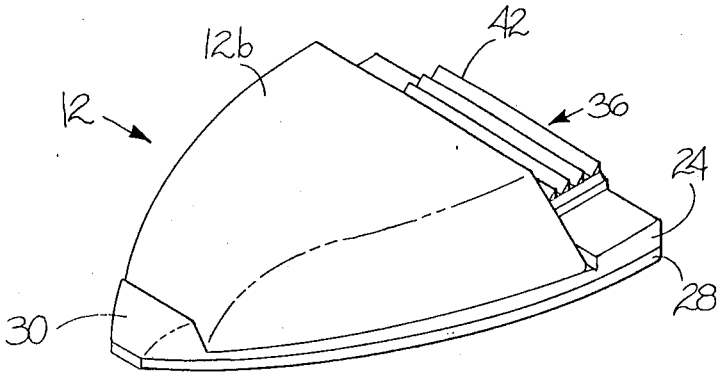
FIG. 3 is a top perspective view of the device in its assembled condition.

As shown in the drawings, the herein described ski damping device comprises a vibration damping component indicated generally at 10, a container or housing for the vibration damping component indicated generally at 12 and a base, indicated generally at 14, for mounting the damping component and attaching it to a selected surface area of the ski.

Damping component 10 preferably comprises a plurality of inertia pellets 16. These, in turn preferably comprise heavy metal pellets such as lead or steel buckshot. For convenience in handling and installation, the pellets are contained in a fabric bag 18.

The pellets are packed into bag 18 in multiple layers. Their quantity will be determined by such factors as their weight, the flexibility and stiffness of the ski, and the conditions under which the ski is to be used.

Container 12 consists of two parts: a bottom plate 12*a*, and a cap piece 12*b*. Cap piece 12*b* is provided with a forwardly extending tongue 20 and a rearwardly extending tongue 22. These serve purposes which will appear hereinafter.

Base 14 includes a bottom plate 24. This is contoured to conform to the contour of the ski surface to which it is to be applied. It is provided with screw holes 26 by means of which it may be affixed to the ski.

Alternatively, adhesive means may be employed for attaching the base to the ski. In the illustrated form of the invention, the adhesive means comprises the two-sided adhesive tape 28.

Releasable fastening means are integral with bottom plate 24 for releasably fastening container 12, and hence the included damping device 10, to base 14.

For this purpose there is provided on the forward portion of bottom plate 24 an integral socket 30. This is contoured and dimensioned to receive tongue 20 on container cap piece 12*b*.

On the rear portion of bottom plate 24 is an upwardly opening socket 31 arranged to removably receive the tongue 22 extending rearwardly on the container cap piece 12*b*. This tongue 22 is secured removably in the socket 31 by a locking detent assembly now to be described.

The rear portion of plate 24, which advantageously can be fabricated of molded plastic, is formed with a first detent component comprising a pair of guideways 32, one on each side, and a central friction member 34.

Cooperating with the first detent component is a second, removable, detent latch component indicated generally at 36.

Like the first detent component, detent component 36 may comprise a piece of molded plastic. It is formed with a pair of marginal slides 38. These are contoured and dimensioned to enter and cooperate with guideways 32 in the first detent component.

Centrally of its undersurface, detent component 36 is provided with a friction element 40 which cooperates with friction element 34 on the first detent component. It is formed further with a thumb grip upper surface 42.

In use, damper 10 is housed in container 12, the two components of which are glued or welded together so as to contain permanently the damper within the container.

Base 14 then is affixed to the selected surface of the ski, using either a screw attachment through screw holes 26 or, preferably, two-sided adhesive tape 28.

The container 12 is then secured removably to the base 14 by first seating the front tongue 20 in the front socket 30 and then lowering the rear tongue 22 into the rear socket 31. The slides 38 of detent latch component 36 then are slid forwardly into guideways 32 to bring component 36 into locking position overlying tongue 22 in socket 31. Friction element 34 engages friction element 40 to secure the component 36 releasably in said locking position.

Figure 4:
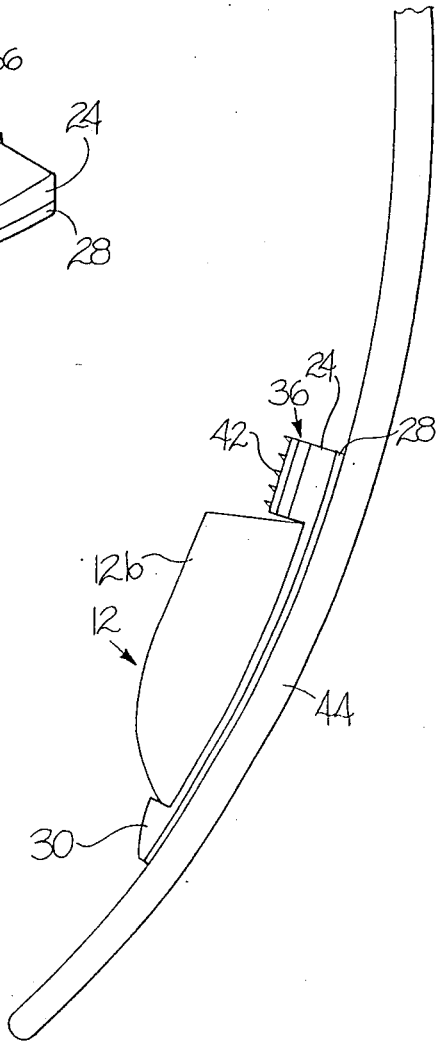
FIG. 4 is a fragmentary side elevation of a ski with the damping device mounted thereon in operative position.
Figure 1:
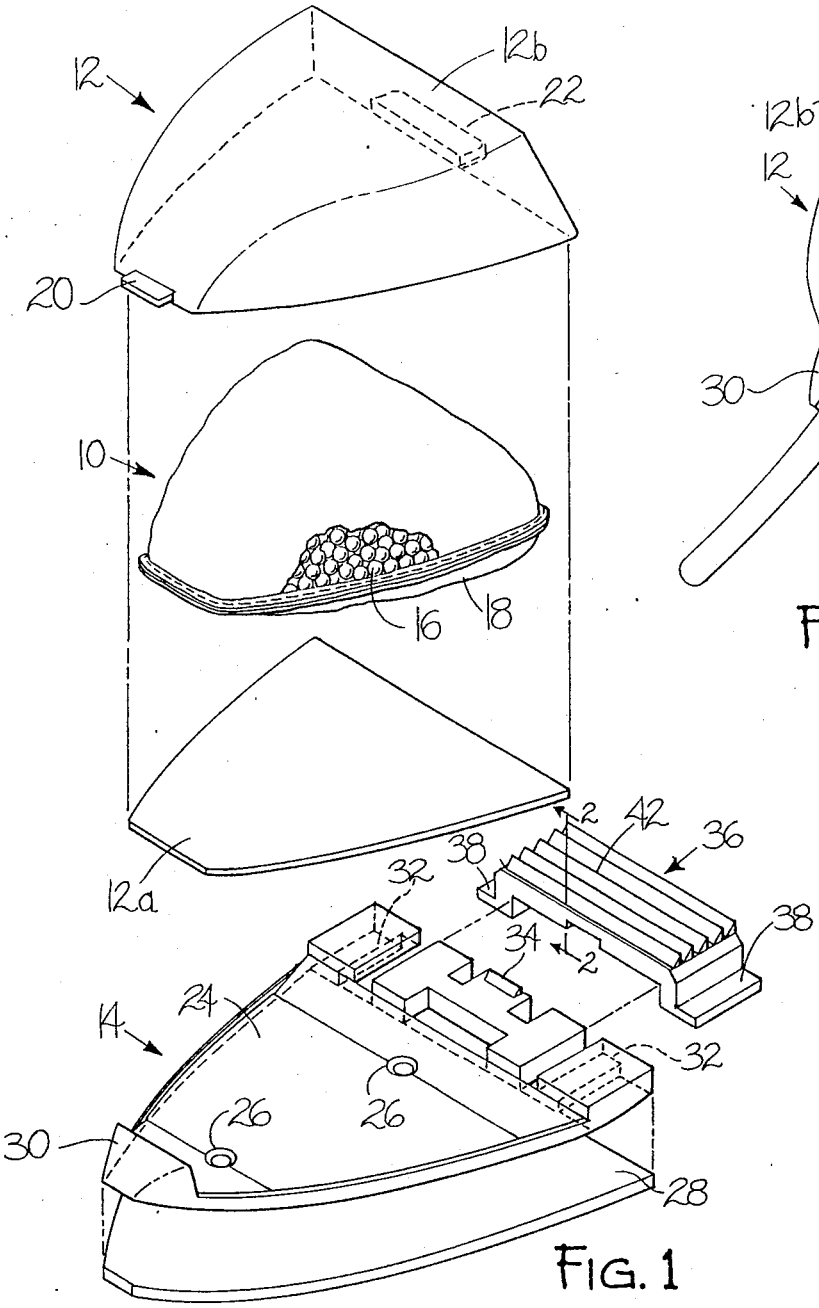
FIG. 1 is a top perspective exploded view illustrating the components of the herein described ski damping device, in their relationship to each other.
Figure 2:
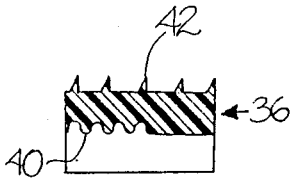
FIG. 2 is a fragmentary detail sectional view taken along line 2—2 of FIG. 1.

The device may be placed in various locations on either the forward end or tail of the ski. However, for most effective operation, it preferably is located on the upper surface of the forward tip end of the ski, as illustrated in FIG. 4.

The operation of the damper is as described above. When the ski starts to vibrate, pellets 16 are displaced vertically with respect to each other. Thereupon the top pellets push those underneath sideways, thereby diverting vertical energy into horizontal energy. The horizontal energy thus developed then is dispersed equally in all directions so that it neutralizes itself and arrests the vibration.

However, by controlling the number of pellets and their weight, and the location of the damping device on the ski, the vibration may be controlled to the desired degree: permitting enough vibration to release the ski from its surface tension bonding to the underlying snow at intervals, thereby producing a lively ski; rather than creating a continuous surface tension bonding to the underlying snow, thereby producing a dead ski.

It is to be noted that since skis produced at the present time are almost universally of laminar construction, the damping device of the invention can be applied to such skis by incorporating the vibration damping means, i.e. bag 18 with its content of buckshot 16, in a pocket formed between the laminae of the skis. In this case, the ski laminae become the container for the damping means as well as the base supporting the same.

Having thus described in detail a preferred embodiment of the present invention, it will be apparent to those skilled in the art that various physical changes could be made in the device described herein without altering the inventive concepts and principles embodied. The present embodiment is there to be considered in all respects as illustrative and not restrictive, the scope of the invention being indicated by the appended claims rather than by the foregoing description. All changes which come within the meaning and range of equivalency of the claims are therefore to be embraced therein.

I claim:

1. A ski damping device comprising:

(a) a hollow container having front and rear ends, (b) a plurality of vibration-damping weighted pellets confined in the container for vertical and horizontal movements therein, (c) a base plate having front and rear ends, (d) fastening means for securing the base plate to a selected area of a ski with the front and rear ends of the base plate facing the front and rear ends, respectively, of the ski, (e) a forwardly projecting tongue on the front end of the container, (f) a front socket on the front end of the base plate configured to removably receive the forwardly projecting tongue, (g) a rearwardly projecting tongue on the rear end of the container, (h) a rear socket on the rear end of the base plate configured to removably receive the rearwardly projecting tongue, and (i) lock means removably engageable with the rear end of the base plate for releasably locking the rearwardly projecting tongue in the rear socket, said locking means including an inverted U-shaped latch component having a pair of outwardly extending marginal slides for sliding engagement with a pair of guideways located at the rear end of the base plate and a friction element at the rear end of the base plate for engaging and locking the latch component to the base plate.

2. The ski damping device of claim 1 including a flexible bag containing the plurality of vibration-damping weighted pellets, the bag being configured for removable reception within the hollow container.

* * * * *